US009625880B2

(12) United States Patent
Girardin et al.

(10) Patent No.: US 9,625,880 B2
(45) Date of Patent: Apr. 18, 2017

(54) SHOCK-PROOF SYSTEM WITH SIMPLIFIED ASSEMBLY FOR TIMEPIECE

(71) Applicant: ETA SA Manufacture Horlogere Suisse, Grenchen (CH)

(72) Inventors: Yves Girardin, Courtetelle (CH); Ivan Villar, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/409,657

(22) PCT Filed: Jun. 19, 2013

(86) PCT No.: PCT/EP2013/062802
§ 371 (c)(1),
(2) Date: Dec. 19, 2014

(87) PCT Pub. No.: WO2013/190012
PCT Pub. Date: Dec. 27, 2013

(65) Prior Publication Data

US 2015/0192901 A1 Jul. 9, 2015

(30) Foreign Application Priority Data

Jun. 21, 2012 (EP) ..... 12173044

(51) Int. Cl.
*G04B 31/02* (2006.01)
*G04B 31/04* (2006.01)

(52) U.S. Cl.
CPC ..... *G04B 31/02* (2013.01); *G04B 31/04* (2013.01)

(58) Field of Classification Search
CPC ..... G04B 31/00; G04B 31/02; G04B 31/04; G04B 17/06; G04B 31/012
(Continued)

(56) References Cited

U.S. PATENT DOCUMENTS 3,500,632 A * 3/1970 Fritz ..... F16C 17/08 368/326
3,712,051 A * 1/1973 Romang ..... G04B 31/04 368/326
(Continued)

FOREIGN PATENT DOCUMENTS

CH 152 145 1/1932
CH 346 173 4/1960
(Continued)

OTHER PUBLICATIONS

International Search Report Issued Oct. 2, 2013 in PCT/EP13/062802 Filed Jun. 19, 2013.

*Primary Examiner* — Sean Kayes
(74) *Attorney, Agent, or Firm* — Oblon, McClelland, Maier & Neustadt, L.L.P.

(57) ABSTRACT

A shock-absorber bearing for a staff of a moving part of a timepiece, the bearing including: a support including a housing configured to receive a pivot module configured to cooperate with the staff; an elastic mechanism configured to exert at least one axial force on the pivot module to retain the pivot module in its housing, the pivot module and the housing having a geometry of revolution defined to have freedom of angular orientation, one relative to the other; and a fixing mechanism for fixing the elastic mechanism.

20 Claims, 4 Drawing Sheets

(58) Field of Classification Search
USPC ..... 368/326
See application file for complete search history.

(56) References Cited

U.S. PATENT DOCUMENTS

| | | | | |
|---|---|---|---|---|
| 4,217,753 | A * | 8/1980 | Loretan | G04B 31/06 29/896.3 |
| 7,234,859 | B2 * | 6/2007 | Kohler et al. | 368/326 |
| 7,344,303 | B2 * | 3/2008 | Conus et al. | 368/324 |
| 8,702,301 | B2 * | 4/2014 | Hiraoka | G04B 17/06 368/324 |
| 8,926,170 | B2 * | 1/2015 | Helfer et al. | 368/326 |

FOREIGN PATENT DOCUMENTS

| | | |
|---|---|---|
| CH | 698 675 | 9/2009 |
| FR | 2 197 423 | 3/1974 |
| FR | 2 307 175 | 11/1976 |

* cited by examiner

SHOCK-PROOF SYSTEM WITH SIMPLIFIED ASSEMBLY FOR TIMEPIECE

CROSS-REFERENCE TO RELATED APPLICATIONS

This is a National Phase Application in the United States of International Patent Application PCT/EP2013/062802 filed Jun. 19, 2013 which claims priority on European Patent application 12173044.4 filed Jun. 21, 2012. The entire disclosures of each of which are hereby incorporated herein by reference.

The present invention relates to a shock-proof system for a staff of a moving part of a timepiece. The staff comprises a small rod, comprising a support, said support being provided with a housing which is intended to receive a pivot system into which the small rod is inserted. The shock-proof system comprises furthermore elastic means designed to exert at least one axial force on said pivot system.

The technical field of the invention is the technical field of precision engineering.

TECHNOLOGICAL BACKGROUND

The present invention relates to bearings for timepieces, more particularly of the type allowing shocks to be absorbed. The constructors of mechanical watches have, for a long time, been designing numerous devices which allow a staff to absorb the energy resulting from a shock, in particular a lateral shock, by abutment against a wall of the hole of the base block which it traverses, whilst allowing a momentary displacement of the small rod before it is returned to its lock position under the action of a spring.

FIGS. 1 and 2 illustrate a device termed inverted double cone which is currently used in timepieces found on the market.

A support 1, the base of which comprises a hole 2 for the passage of the balance staff 3 ended by a small rod 3*a*, makes it possible to position a jewelled bearing 20 in which there are immobilised a pierced stone 4 traversed by the small rod 3*a* and a counter-pivot stone 5. The jewelled bearing 20 is retained in a housing 6 of the support 1 by a spring 10 which, in this example, comprises radial extensions 9 which compress the counter-pivot stone 5. The support 1 is a part of revolution comprising a circular rim 11. This rim 11 is interrupted at two places which are diametrically opposite by an opening 10 so as to create two semi-circular rims 11*a*, 11*b*. The opening 12 is provided in part in the two semi-circular rims 11*a*, 11*b* so as to produce two returns 13. The jewelled bearing 20 is retained in a housing 6 of the support 1 by elastic means, such as a spring 10, which comprises, in this example, radial extensions 9 which compress the counter-pivot stone 5. The spring 10 is of the axial type and has the shape of a lyre designed to be supported under the returns of the semi-circular rims 11*a*, 11*b*. The housing 6 comprises two bearing surfaces 7, 7*a* in the form of inverted cones on which complementary bearing surfaces 8, 8*a* of the jewelled bearing 20 are supported, said bearing surfaces requiring to be produced with very great precision. In the case of axial shock, the pierced stone 4, the counter-pivot stone 5 and the balance staff are displaced and the spring 10 acts alone to return the balance staff 3 into its initial position. The spring 10 is dimensioned to have a displacement limit so that, beyond this limit, the balance staff 3 comes into contact with stops 14 making it possible for said staff 3 to absorb the shock, which the small rods 3*a* of the staff 3 cannot do without the risk of breaking. In the case of lateral shock, i.e. when the end of the small rod unbalances the jewelled bearing 20 out of its lock plane, the spring 10 cooperates with the complementary inclined planes 7, 7*a*; 8, 8*a* in order to re-centre the jewelled bearing 20. Such bearings have been sold for example under the trademark Incabloc®. These springs can be produced in chromium-cobalt alloy or brass and are manufactured by traditional cutting means.

Now, a disadvantage of these shock-absorber systems is that their assembly is not easy. In fact some parts, such as the support 1 and the spring 10, must be orientated and manipulated in a certain manner during the assembly operation in order that the assembly can take place. Hence, the assembly of the shock-absorber system begins by being provided with a support, then a jewelled bearing with these stones. The latter is placed in the housing of the support. Then a spring of the axial type is provided, which has the shape of a lyre. The latter is manipulated so that it can be supported under the returns of the semi-circular rims 11*a*, 11*b* of the support.

Consequently, positioning the spring and fixing it to the support requires a specific manipulation. For this reason, shock-absorber systems must be assembled in part manually because a robot cannot produce such a complex manipulation.

Furthermore, the current shock-absorber systems are assembled in part manually and not by a robot because human beings are capable of knowing immediately the orientation in which the parts of the shock-absorber system must be placed relative to each other. In fact whatever the shape of the parts, human beings are able to know immediately how they must manipulate these parts in order to assembly them. Now, even if a robot can distinguish the orientation of one piece relative to another, this requires a more complex and more expensive robot whilst requiring more time. This reduces consequently the manufacturing output.

Hence, total automation of the assembly is not possible and the assembly process of the shock-absorber systems is therefore more expensive.

SUMMARY OF THE INVENTION

The object of the invention is to remedy the disadvantages of prior art by proposing to provide a shock-absorber system, the assembly of which can be automated.

To this end, the invention relates to a shock-absorber bearing for a staff of a moving part of a timepiece, said bearing comprising a support provided with a housing which is intended to receive a pivot module designed to cooperate with said staff, said bearing comprising furthermore elastic means designed to exert at least one axial force on said pivot module in order to retain said pivot module in its housing, the pivot module and the housing having a geometry of revolution which is defined so as to have freedom of angular orientation, one relative to the other, said bearing comprising furthermore fixing means for fixing the elastic means to the support, characterised in that furthermore at least the elastic means have a geometry of revolution which is defined so as to have freedom of angular orientation relative to the pivot module and to the housing and in that said fixing means are designed to fix the elastic means to the support whatever the angular orientation of the elastic means relative to the pivot module and to the housing.

A first advantage of the present invention is to allow simplification of the assembly of a shock-absorber system allowing automation of said process. In fact, it means that the support, its housing, the pivot module and the elastic means are configured to be angularly free relative to each other. This characteristic makes it possible not to need to worry about the angular position of one element relative to another so that a robot can assemble the shock-absorber system.

Advantageous embodiments of the invention are the subject of the dependent claims.

In a first advantageous embodiment, the support, the housing, the pivot module and the elastic means each have a defined geometry so as to have freedom of angular orientation relative to each other.

In a second advantageous embodiment, the fixing means are a material linkage between said support and said elastic means.

In a third advantageous embodiment, the fixing means comprise a cap which is fixed to said support in order to place said elastic means against said support.

In another advantageous embodiment, the fixing means comprise at least two fins disposed on the support and extending parallel to the central axis of said support, said at least two fins being able to be folded down in order to squeeze said elastic means.

In another advantageous embodiment, the fixing means comprise a plurality of fins which are disposed in a circle and distributed regularly.

In another advantageous embodiment, the elastic means comprise an annular spring which has at least one internal radial extension extending towards the centre of said annular spring.

In another advantageous embodiment, said annular spring comprises three internal radial extensions.

To this end, the invention likewise relates to a clock movement comprising a bottom plate and at least one bridge, said bottom plate comprising an orifice, characterised in that, into said orifice of said bottom plate, a shock-absorber bearing according to the invention is inserted.

In an advantageous embodiment, said at least one bridge comprises an orifice, characterised in that, into said orifice of said at least one bridge, a shock-absorber bearing according to the invention is inserted.

In another advantageous embodiment, the support of the shock-absorber bearing and said bottom plate are monobloc.

In another advantageous embodiment, the support of the shock-absorber bearing and said at least one bridge are monobloc.

To this end, the invention relates likewise to a timepiece comprising a width closed by a casing and a base, characterised in that said timepiece comprises a clock movement according to the invention.

BRIEF DESCRIPTION OF THE FIGURES

The aims, advantages and features of the shock-proof system according to the present invention will appear more clearly in the following detailed description of at least one embodiment of the invention which is given solely by way of non-limiting example and illustrated by the annexed drawings in which.

DETAILED DESCRIPTION

The present invention arises from the general inventive idea which consists of acquiring a simple non-dismantlable shock-absorber bearing which is easy to assemble. This shock-absorber system is designed to be mounted on a bottom plate and/or on at least one bridge of a clock movement. The clock movement is placed in a timepiece comprising a width closed by a base and a crystal.

Figure 3:
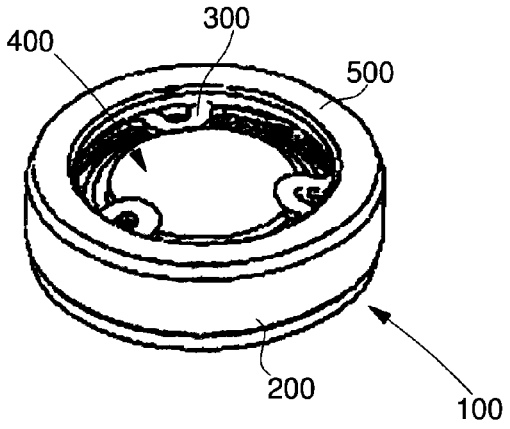
FIG. 3 represents schematically a shock-absorber system of the timepiece according to the invention.
Figure 4A:
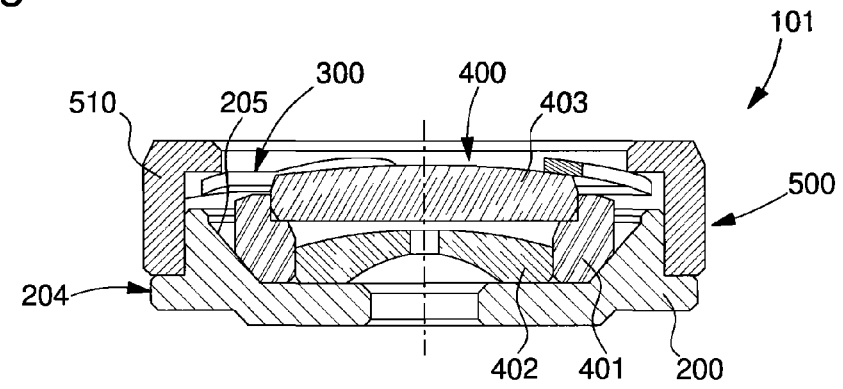
FIGS. 4*a* and 4*b* represent a profile view of the shock-absorber system of the timepiece according to the invention.
Figure 4B:
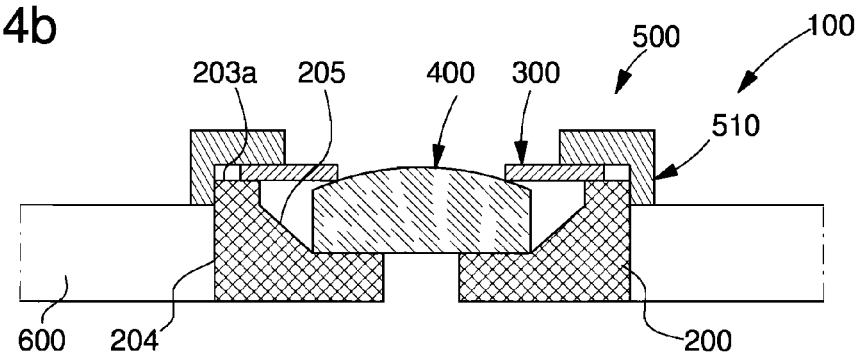

In FIGS. 3, 4*a* and 4*b*, a shock-absorber bearing 100 or shock-proof system according to a first embodiment is represented. This shock-proof system 100 is mounted in a base element of a timepiece movement. In particular, the bottom plate or the bridges 600 of the movement are the base element in which the shock-proof system 100 according to the invention is placed. This shock-proof system 100 comprises a support 200. This support 200 has the shape of a base 201, provided with a hole 202, from which a peripheral rim 203 extends. The latter has an external flank 204, an internal flank 205 and a top 203*a*. This rim 203 makes it possible to define a housing 206 into which a pivot module 400 is inserted. A standard pivot module 400 comprises a jewelled bearing 401, i.e. a part which has a circular central orifice, an external wall and an internal wall. In the central orifice, a pierced stone 402 is inserted, the diameter of which corresponds to that of the central orifice. The internal wall comprises a shoulder so that a counter-pivot stone 403 can be fixed. The pivot module 400 is then placed in the housing 206 of the support 200 and cooperates with the small rod of a staff.

The shock-proof system 100 comprises furthermore elastic means 300 which are designed to cooperate with the pivot module 400 so as to absorb shocks and to return it into its lock position when the stresses associated with the shocks subside. The elastic means 300 are fixed on the support 200. Preferably, the elastic means 300 are likewise placed on the pivot module 400. The shock-proof system 100 is then inserted into an orifice of the bottom plate or into one of the bridges of the movement.

Advantageously according to the invention, at least the housing 206, the pivot module 400 and the elastic means 300 are produced/designed so that the various parts are angularly free relative to each other. There is understood by this that the various parts which make up the shock-absorber system 100, such as at least the housing 206, the pivot module 400 and the elastic means 300, are assembled one in the other without a particular manipulation being necessary. Thus no rotation or manipulation or torsion takes place during assembly. For preference, at least the housing 206, the pivot module 400 and the elastic means 300 are parts of revolution, i.e. having a general circular shape. This circular shape makes it possible to adapt to any support shapes 200. Effectively, the circular shape, without orientation, of the housing 206, of the pivot module 400 and of the elastic means 300 makes it possible to have a support 200 of any shape which, during assembly, will be positioned in any manner without that having any impact on the assembly process of the shock-absorber bearing 100.

In a first embodiment which can be seen in FIG. 3, the support 200, the housing 206, the pivot module 400 and the elastic means 300 are parts of revolution, i.e. having a circular shape.

Figure 5:
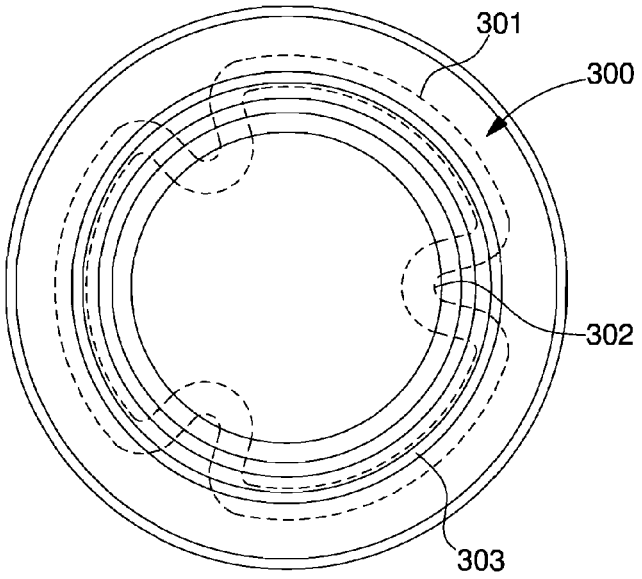
FIG. 5 represents schematically a view from above of a spring for the shock-absorber system of the timepiece according to the invention.

The elastic means 300 have, for example, the shape of an annular spring 301. This annular spring 301 is of the flat type, i.e. it is formed from a circular metallic strip which has a greater width than thickness. In order to place said pivot module 400 in the housing 206 of the support 200, the annular spring 301 comprises internal radial extensions 302 which are disposed between the annular portions 303. These internal radial extensions 302 are formed by the strip which forms the ring 301 which is curved back towards the inside of the ring 301. These internal radial extensions 302 are preferably distributed regularly over the circumference of the flat ring 301 so that the annular spring 301 can act homogeneously as can be seen in FIG. 5. It is therefore understood that the annular spring 301 can be orientated in any manner relative to the support 200.

This configuration of the parts of the shock-absorber bearing 100 according to the invention makes it possible to facilitate assembly. In fact, if the parts have an orientation relative to each other, it is necessary to manipulate them so that the assembly can take place. For example, in order to fit together two triangular geometric Figures one in the other, it is necessary that each of the sides is parallel, an orientation is therefore necessary.

Now, when producing the support 200, the housing 206, the pivot module 400 and the elastic means 300 so that the various parts are angularly free relative to each other, it is possible to take, for example, the pivot module 400 and to place it in the housing 206 without any prior manipulation.

Figure 1:
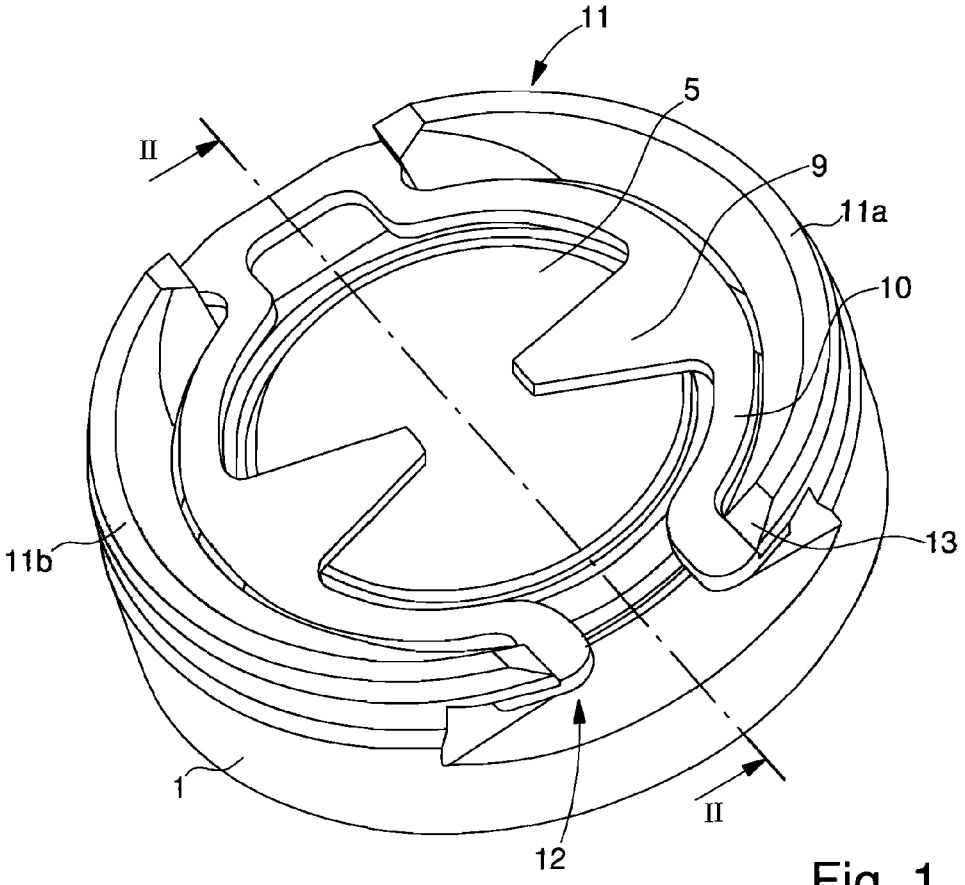
FIGS. 1 and 2, already cited, make it possible to represent schematically a shock-absorber system of a timepiece according to prior art.
Figure 2:
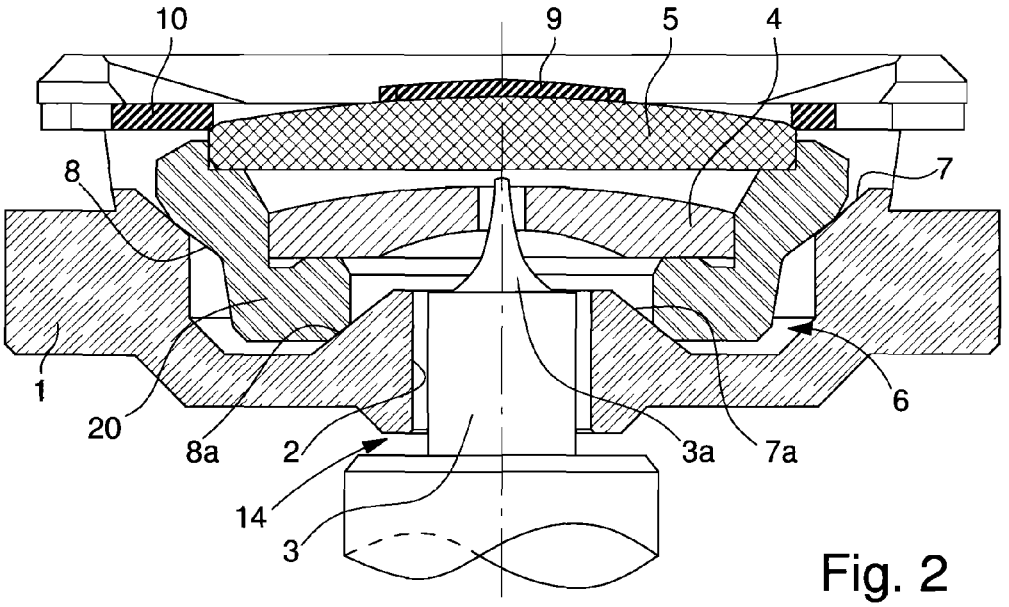

The present invention makes it possible to dispense with orientation of the parts relative to each other. Furthermore, this makes it possible to simplify fixing of the spring and thus to simplify the assembly process. In fact, these parts of the shock-absorber bearing 100 are designed so that the elastic means 300 are placed on the support 200 then fixed without there being any need for manipulation for the spring of FIG. 1, which is of the axial type and which has the shape of a lyre, to be able to be supported under the returns of the semi-circular rims 11*a*, 11*b* of the support. The shock-absorber bearing 100 can then be mounted vertically or axially. This means that the various parts forming the shock-absorber bearing 100 can be assembled by placing them one on the other from the top.

Consequently, the obstacles with respect to complete and effective automation of the assembly process are removed.

In order that the elastic means 300 can be fixed on the support 200, fixing means 500 are used. Advantageously, these fixing means 500 are designed so that the various parts, including the fixing means 500, remain angularly free relative to each other. In the following description, we will consider the example according to which the support 200, the housing 206, the pivot module 400 and the elastic means 300 are circular parts.

Figure 6:
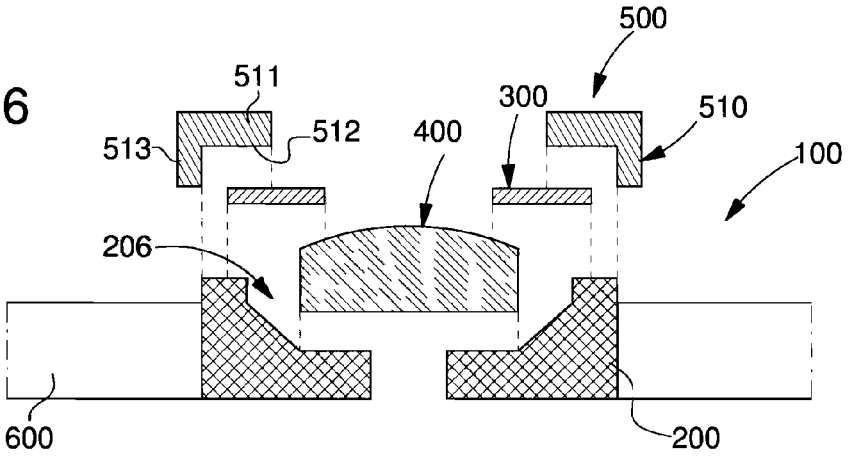
FIG. 6 represents an exploded profile view of the shock-absorber system of the timepiece according to the invention.

In a first solution which can be seen in FIGS. 4*a*, 4*b* and 6, the fixing means 500 comprise a supplementary part 510 which serves to fix the elastic means on the support. This supplementary part has the shape of a cap 510 which is fixed on the support 200. This cap 510 is designed so that, during fixing to the support 200, the elastic means 300 situated between said cap 510 and said support 200 are in part squeezed by the cap 510 and the support 200. Preferably, the squeezing is effected over a specific zone of the elastic means 300, preferably over the annular parts 303, so that the elastic properties are not altered.

This cap has the shape of a ring 511. This ring comprises a flat ring which has a lower face 512, i.e. the face opposite the support 200, from which a peripheral blade 513 extends. This peripheral blade 513 extends perpendicularly to the plane of the flat ring. The dimensions are defined so that, when the cap 510 is placed on the support 200, the blade 513 is in contact with the support at the level of the external flank 204. The dimensions of the cap 510 make it possible for the latter to be slid over the support 200. A cap 510 which can be dismantled is therefore obtained.

In an alternative to this first solution, the support 200 comprises a slot into which the blade of the cap is inserted. This slot is the negative of the blade so that it can be inserted perfectly in said slot. Interaction between the blade 513 and the walls of the slot generates a friction which ensures fixing of the blade 513 in the slot and therefore of the cap 510 on the support 200.

Figure 8:
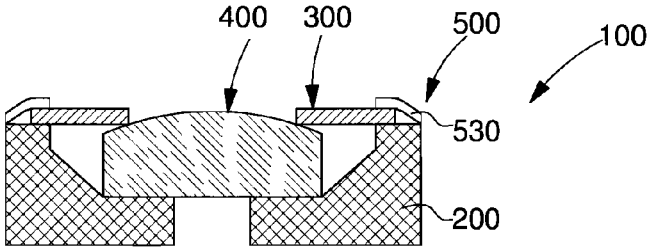

In a second solution which can be seen in FIG. 8, the fixing means 500 comprise rivets. These rivets have the shape of strips or fins 530 provided on the support 200 at the level of the top 203*a* of the support 203. These strips are disposed so that their width extends parallel to the central axis of the support and so that their length extends perpendicularly to the central axis of the support. For preference, the strips are designed to assume the shape of the internal flank of the rim of the support 200. In fact, if the support 200 is of a circular shape, the internal flank of the rim has a circular shape and the strips have a curve which follows the shape of the internal flank of the rim 200. The various strips are therefore designed to form a circle. During assembly of the annular spring 301, i.e. of the elastic means 300, the annular portions 303 are placed on the top 203*a* of the rim 203. Fixing of the annular spring takes place by folding down the strips which form the rivets over said annular spring 301. These thus folded-down strips squeeze the annular portions 303 of the annular spring so that the latter can no longer move. In order to fix said annular spring 301, it will be understood that the fixing means 500 comprise at least two strips, given that the greater the number of strips, the more effective the fixing and centring. Effectively the greater the number of strips, the more will the surface of the annular spring 301 be squeezed by the strips. Likewise, the greater the number of strips, the more stable will be the annular spring 301 during assembly.

Figure 7:
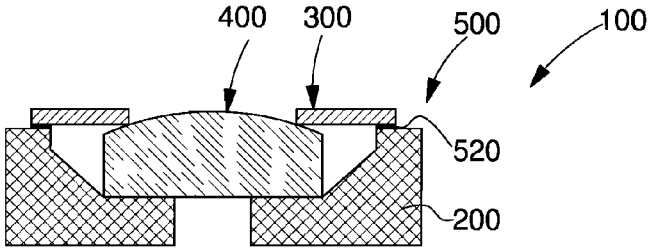
FIGS. 7 and 8 represent various solutions for fixing the spring for the shock-absorber system of the timepiece according to the invention.

In a third solution which can be seen in FIG. 7, the fixing means which make it possible to fix the annular spring comprise a material linkage 520. This material linkage is placed between the support 203 and the annular spring. This material linkage has the form of a weld/solder joint or of a glue used for fixing, integrally, the annular spring 301 to the support 200. This material linkage can be formed by a multitude of weld/solder spots or by glue or by a continuous line which runs across the entire perimeter of the annular spring 301. This embodiment has the advantage of using a tested and simple technology so that the assembly process is not made complex.

These various solutions make a vertical assembly possible. There is understood by this that the various parts are assembled according to their disposition in the structure of the shock-absorber bearing 100. Hence, for said bearing 100, the assembly process consists of providing the support 200. Then the pivot module 400 is provided which is then placed in the housing of the support 200. Then, the spring is provided which comes to be placed on the support. Finally, the fixing means 500 are placed and fixed on the support 200. By combining the advantage of being able to produce a vertical or axial assembly with the fact that the parts are not orientated relative to each other, an assembly process which can be automated easily is obtained.

Advantageously, all the parts forming the shock-absorber bearing 100 are produced so that they are angularly free relative to each other. Thus the housing 206, the pivot module 400, the elastic means 300 are angularly free relative to each other and, preferably, are circular. This configuration makes it possible to take each part as it comes without orientating it.

Figure 9:
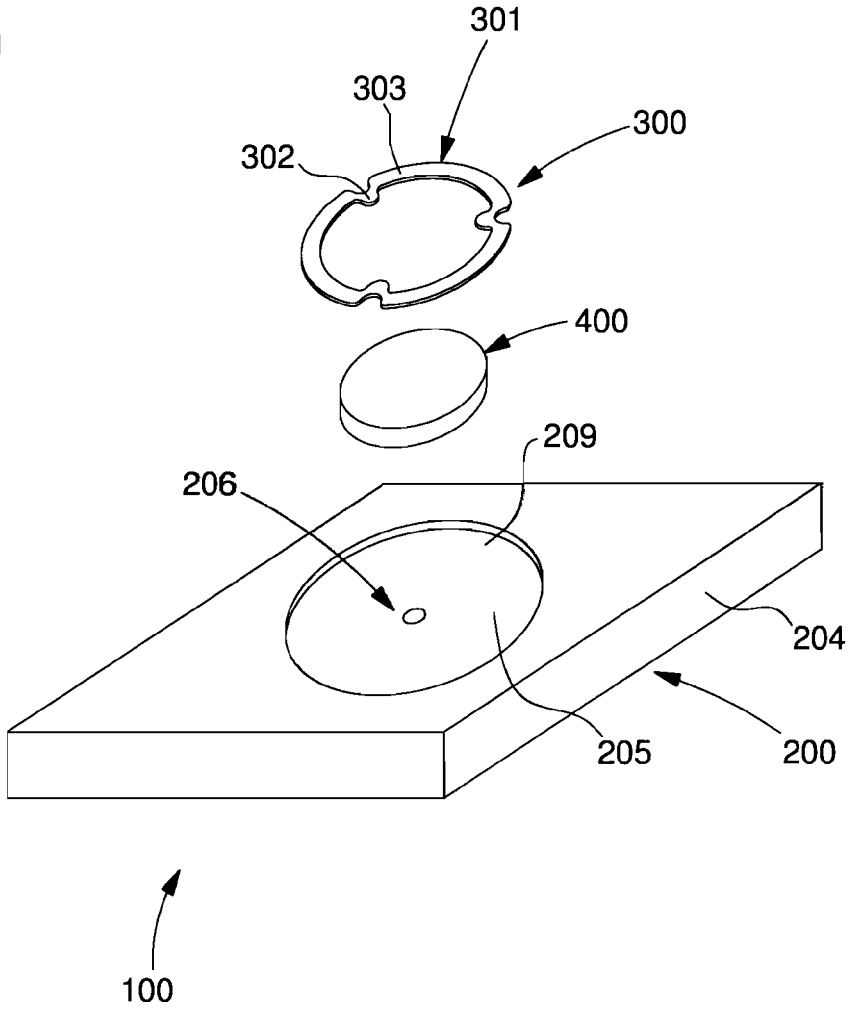
FIG. 9 represents schematically a first variant of the shock-absorber of the timepiece according to the invention.

In a first variant of the first embodiment which can be seen in FIG. 9, the support 200 is not circular, it can be of any shape. In this variant, the support has a mounting zone 209 representing the zone reserved for mounting the elastic means 300. This mounting zone 209 has a shape similar to that of the housing 206, of the pivot module 400 and of the elastic means 300, i.e. circular, in the example taken for the first embodiment. The fact that the support 200 has a mounting zone 209 which has a shape similar to that of the housing 206, of the pivot module 400 and of the elastic means 300 allows simplified mounting in all cases. Effectively, this specific zone 209 allows use of fixing means 500 according to the three solutions explained previously since one specific zone is specially designed. This mounting zone 209 requires a design of the support 200, the dimensions of which take into account the presence of said mounting zone 209. For example, if the support 200 has any shape, such as a triangular shape, the space for using the fixing means 300 according to the three solutions explained previously is not necessarily present. It is on this mounting zone 209 that the elastic means 300 will be supported, in part, and will be fixed. Hence, the mounting zone 209 will be the zone on which the elastic means 300 will be fixed by a material linkage such as welding or gluing. This zone can also be used so that a cap 510 can be fixed there, a slot which is the negative of the blade 513 of the cap 510 is hollowed out in order to allow fixing of said cap. Finally, this mounting zone 209 can be the zone on which the strips serving as rivets are provided.

Figure 10:
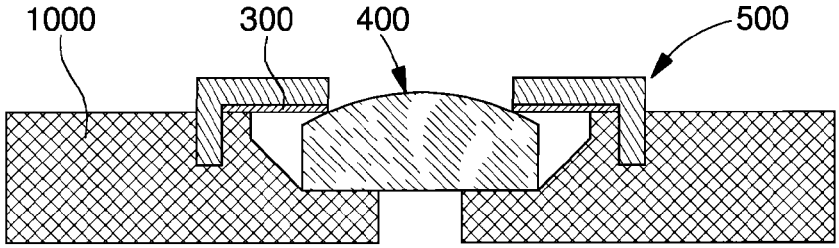
FIG. 10 represents schematically a second variant of the shock absorber of the timepiece according to the invention.

In a second variant which can be seen in FIG. 10, the support 200 and the base element of the movement 500 in which the shock-absorber bearing 100 is placed are simply one and the same part, the support 200 and the base element are therefore monobloc. It is therefore understood that the base element has a recess provided to form a base pierced by a hole and forming the housing 206 in which the pivot module 400 is placed. It is likewise understood that this second variant can exist together with the first variant. In fact, as a bridge or a bottom plate has any shape, a provided mounting zone 209 makes it possible to be sure of being able to install the fixing means and thus to retain the pivot module 400 in the housing.

It will be understood that various modifications and/or improvements and/or combinations which are evident to the person skilled in the art can be applied to the various embodiments of the invention which is presented above without departing from the scope of the invention defined by the annexed claims.

In fact, it is possible that the pivot module 400 can be formed from a single stone or that the pierced stone and the counter-pivot stone are integral one with the other. It is understood that the pierced stone and the counter-pivot stone can slide one into the other or be monobloc. These possibilities make it possible to limit the number of parts of the shock-absorber bearing.

The invention claimed is:

1. A shock-absorber bearing for a staff of a moving part of a timepiece, the bearing comprising:

a support including a housing configured to receive a pivot module configured to cooperate with the staff, the pivot module including at least one stone;

an elastic mechanism configured to exert at least one axial force on a top of the at least one stone towards the staff to retain the pivot module in its housing, the pivot module and the housing having a geometry of revolution defined to have freedom of angular orientation, one relative to the other;

a fixing mechanism to fix the elastic mechanism to the support;

wherein at least the elastic mechanism has a geometry of revolution defined to have a 360° freedom of angular orientation relative to the pivot module and to the housing, and the fixing mechanism is configured to fix the elastic mechanism to the support whatever an angular orientation of the elastic mechanism relative to the pivot module and to the housing, allowing the bearing to be mounted vertically from top to down by placing elements of the bearing one on the other.

2. The shock-absorber bearing according to claim 1, wherein the support, the housing, the pivot module, and the elastic mechanism each have a defined geometry to have freedom of angular orientation relative to each other.

3. The shock-absorber bearing according to claim 2, wherein the fixing mechanism is a material linkage between the support and the elastic mechanism.

4. The shock-absorber bearing according to claim 2, wherein the fixing mechanism comprises a cap fixed to the support to place the elastic mechanism against the support.

5. The shock-absorber bearing according to claim 2, wherein the fixing mechanism comprises at least two fins disposed on the support and extending parallel to a central axis of the support, the at least two fins configured to be folded down to squeeze the elastic mechanism.

6. The shock-absorber bearing according to claim 5, wherein the fixing mechanism comprises a plurality of fins disposed in a circle and distributed regularly.

7. The shock-absorber bearing according to claim 6, wherein the elastic mechanism comprises an annular spring including three internal radial extensions.

8. The shock-absorber bearing according to claim 5, wherein the elastic mechanism comprises an annular spring including three internal radial extensions.

9. The shock-absorber bearing according to claim 1, wherein the fixing mechanism is a material linkage between the support and the elastic mechanism.

10. The shock-absorber bearing according to claim 1, wherein the fixing mechanism comprises a cap fixed to the support to place the elastic mechanism against the support.

11. The shock-absorber bearing according to claim 1, wherein the fixing mechanism comprises at least two fins disposed on the support and extending parallel to a central axis of the support, the at least two fins configured to be folded down to squeeze the elastic mechanism.

12. The shock-absorber bearing according to claim 11, wherein the fixing mechanism comprises a plurality of fins disposed in a circle and distributed regularly.

13. The shock-absorber bearing according to claim 12, wherein the elastic mechanism comprises an annular spring including three internal radial extensions.

14. The shock-absorber bearing according to claim 1, wherein the elastic mechanism comprises an annular spring including at least one internal radial extension extending towards a center of the annular spring.

15. The shock-absorber bearing according to claim 14, wherein the annular spring comprises three internal radial extensions.

16. A clock movement comprising a bottom plate and at least one bridge, the bottom plate comprising an orifice, wherein, into the orifice of the bottom plate, a shock-absorber bearing according to claim 1 is inserted.

17. The clock movement according to claim 16, wherein the support of the shock-absorber bearing and the bottom plate are monobloc.

18. A timepiece comprising a width closed by a casing and a base, wherein the timepiece comprises a clock movement according to claim 16.

19. A clock movement comprising a bottom plate and at least one bridge, the at least one bridge comprising an orifice, wherein, into the orifice of the at least one bridge, a shock-absorber bearing according to claim 1 is inserted.

20. The clock movement according to claim 19, wherein the support of the shock-absorber bearing and the at least one bridge are monobloc.

* * * * *